US008297595B2

(12) United States Patent
Shen et al.

(10) Patent No.: US 8,297,595 B2
(45) Date of Patent: Oct. 30, 2012

(54) ADJUSTABLE HYDRAULIC HORIZONTAL JACK

(75) Inventors: Min Shen, Jiangsu (CN); Jiang Chen, Jiangsu (CN); Jingfang Wang, Jiangsu (CN)

(73) Assignee: Changshu Tongrun Auto Accessory Co., Ltd., Jiangsu (CN)

( * ) Notice: Subject to any disclaimer, the term of this patent is extended or adjusted under 35 U.S.C. 154(b) by 390 days.

(21) Appl. No.: 12/694,837

(22) Filed: Jan. 27, 2010

(65) Prior Publication Data

US 2011/0062401 A1 Mar. 17, 2011

(30) Foreign Application Priority Data

Sep. 16, 2009 (CN) ..... 2009 1 0182545

(51) Int. Cl.
*A62B 3/00* (2006.01)

(52) U.S. Cl. ..... 254/93 R; 254/89 H

(58) Field of Classification Search ..... 254/93 R, 254/8 B, 89 H
See application file for complete search history.

(56) References Cited

U.S. PATENT DOCUMENTS

| | | | | |
|---|---|---|---|---|
| 2,587,067 | A * | 2/1952 | Sachtleber | 254/126 |
| 4,251,056 | A * | 2/1981 | Maniglia | 254/8 B |
| 5,421,554 | A * | 6/1995 | Hsu | 254/8 B |
| 5,618,029 | A * | 4/1997 | Chung | 254/8 B |
| 6,929,248 | B1 * | 8/2005 | Matney et al. | 254/8 B |
| 8,066,259 | B2 * | 11/2011 | Fang et al. | 254/8 B |

* cited by examiner

*Primary Examiner* — Basil Katcheves
(74) *Attorney, Agent, or Firm* — Christie, Parker & Hale, LLP

(57) ABSTRACT

An adjustable hydraulic horizontal jack including a frame, a hydraulic unit, a jib unit, link rods, and a handle. Here, the structures of the jib and the link rod(s) are improved according to an embodiment. With the improved structures, the jack has rational structures and can act reliably. In addition, under the parameters equivalent to those of conventional hydraulic horizontal jacks, the jack of an embodiment of the present invention can change the height of the lowest position and the load by adjusting the length of the jib and link rods. Therefore, the jack is adapted to jacking up not only a light automobile with a low chassis but also a heavy automobile with a high chassis, thus having a wider scope of application.

1 Claim, 1 Drawing Sheet

ADJUSTABLE HYDRAULIC HORIZONTAL JACK

CROSS-REFERENCE TO RELATED APPLICATION(S)

This application claims priority to and the benefit of Chinese Patent Application Number 200910182545.8, filed in the State Intellectual Property Office (SIPO) of China on Sep. 16, 2009, the entire content of which is incorporated herein by reference.

FIELD OF THE INVENTION

The present invention relates to lifting apparatus, and more particularly, to an adjustable hydraulic horizontal jack with improvements to structures of a jib and link rods of the hydraulic horizontal jack.

BACKGROUND OF THE INVENTION

At present, the common hydraulic horizontal jacks in the market mainly include a frame, a hydraulic unit, a jib unit, a link rod, and a handle, wherein, the jib unit includes a jib and a bracket arranged on the jib; one end of the link rod is pivotally attached to the frame, and the other end of the link rod is hinged to the bracket of the jib unit. When a heavy object is to be lifted, the handle can be pressed repeatedly, so that the hydraulic unit will drive the jib unit to lift upwards, and finally the bracket of the jib jacks up the heavy object. A drawback of the structure described above is: for the hydraulic horizontal lifting jacks with the same standards (i.e., the parameters such as oil pressure and stroke, etc. are constant), the lifting height and bearing capacity are constant because the lengths of jib and link rod can not be adjusted. Therefore, it has limited function and is applied only in a narrow field. To overcome the above drawbacks, a type of hydraulic horizontal jack with a high tray is introduced into the market. However, such a hydraulic horizontal jack improves nothing except increasing the height of the lowest position, and still has limited function.

SUMMARY OF THE INVENTION

An aspect of an embodiment of the present invention is directed toward an adjustable hydraulic horizontal jack, which has rational structure, can act reliably, can effectively change the height of the lowest position and the load by adjusting the lengths of jib and link rod, and can be applied in a wider scope.

An embodiment of the present invention is achieved as follows: an adjustable hydraulic horizontal jack, including a frame, a hydraulic unit, a jib unit, link rods, and a handle, wherein, the jib unit includes a bracket, a front arm, a rear arm, a set pin, and a pin roll; the bracket is hinged to one end of the front arm, the other end of the front arm is hinged via the pin roll to one end of the rear arm, and the other end of the rear arm is pivotally attached to the frame; the link rods include a first link rod, a second link rod, and a link rod pin; one end of the first link rod is pivotally attached to the frame, the other end of the first link rod is hinged via the link rod pin to one end of the second link rod, and the other end of the second link rod is hinged to the bracket; a connecting plate is arranged between the front arm and the second link rod, one end of the connecting plate is hinged to the pin roll, and the other end of the connecting plate is hinged to the link rod pin; the set pin is used to form a fixed joint between the bracket and the front arm when the jib and link rods are in a folded position, and to form a fixed joint between the front arm and the rear arm when the jib and link rods are in a normal position.

With the above structures, the jack of an embodiment of the present invention has rational structures and can act reliably. In addition, under the parameters equivalent to those of conventional hydraulic horizontal jacks, the jack of an embodiment of the present invention can change the height of the lowest position and the load by adjusting the length of the jib and link rods. Therefore, the jack is adapted to jacking up not only a light automobile with a low chassis but also a heavy automobile with a high chassis, thus having a wider scope of application.

BRIEF DESCRIPTION OF THE DRAWINGS

The accompanying drawings, together with the specification, illustrate exemplary embodiments of the present invention, and, together with the description, serve to explain the principles of the present invention.

EXPLANATION OF THE REFERENCE NUMERALS

Figure 1:
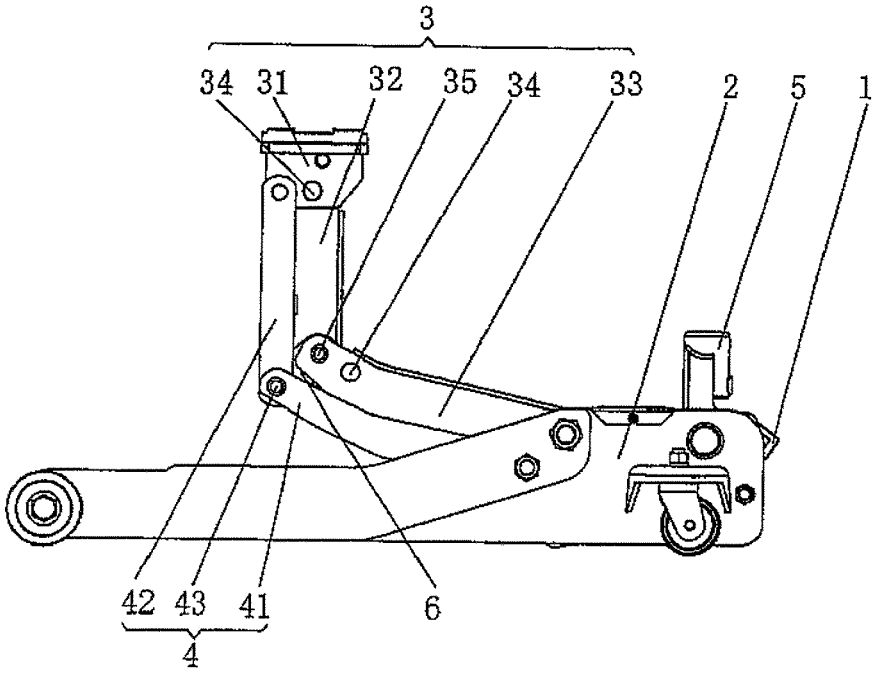
FIG. 1 is a structure illustration of an embodiment of a jack of an embodiment of the present invention in lifting state, with a jib and link rods in a folded position.

1. hydraulic unit;
2. frame;
3. jib unit; 31. bracket; 32. front arm; 33. rear arm; 34. set pin; 35. pin roll;
4. link rods; 41. first link rod; 42 second link rod; 43. link rod pin;
5. handle;
6. connecting plate.

DETAILED DESCRIPTION OF THE EMBODIMENTS

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when a first element is referred to as being "on" a second element, it can be directly on the second element or be indirectly on the second element with one or more intervening elements interposed therebetween. Like reference numerals designate like elements throughout the specification.

Embodiment 1

FIG. 1 shows a structure illustration according to a hydraulic horizontal jack of an embodiment of the present invention in lifting state, with a front arm 32 of a jib unit 3 and a second link rod 42 of the link rods 4 in a folded position.

Referring to FIG. 1, the hydraulic horizontal jack of the embodiment of the present invention includes the frame 2, the hydraulic unit 1, the jib unit 3, the link rods 4, a handle 5, and a connecting plate 6. The frame 2, the hydraulic unit 1, and the handle 5 are well-known in the art, and therefore will not be described further here. The technical feature of an embodiment of the present invention is the improvement of the jib unit 3 and link rods 4, wherein, the jib unit 3 includes a bracket 31, a front arm 32, a rear arm 33, a set pin 34, and a pin roll 35; the bracket 31 is hinged to one end of the front arm 32, the other end of the front arm 32 is hinged via the pin roll 35 to one end of the rear arm 33, and the other end of the rear arm 33 is pivotally attached to the frame 2, and the set pin 34 is arranged between the bracket 31 and the front arm 32 to form a fixed joint between them; the link rods 4 include a first link rod 41, a second link rod 42, and a link rod pin 43, wherein, one end of the first link rod 41 is pivotally attached to the frame 31, the other end of the first link rod 41 is hinged via the link rod pin 43 to one end of the second link rod 42, and the other end of the second link rod 42 is hinged to the bracket 31; the connecting plate 6 is arranged between the front arm 32 and the second link rod 42, wherein, one end of the link plate 6 is hinged to the pin roll 35, and the other end of the connecting plate 6 is hinged to the link rod pin 43. When the jack is to be used in folded state to lift a heavy object, the front arm 32 is turned around the pin roll 35 to drive the second link rod 42 to fold around the connecting plate 6 to a certain angle (as shown in FIG. 1); then, the handle 5 can be pressed repeatedly, so that the hydraulic unit 1 drives the jib unit 3 to lift upwards, and finally the bracket 31 jacks up the heavy object.

With the structure described above, under equivalent parameters, when the front arm 32 of the jib unit 3 and the second link rod 42 are in a folded position, the jack of the present invention can jack up a heavy automobile with a high chassis, such as a sports utility vehicle (SUV) or pickup truck.

Embodiment 2

Figure 2:
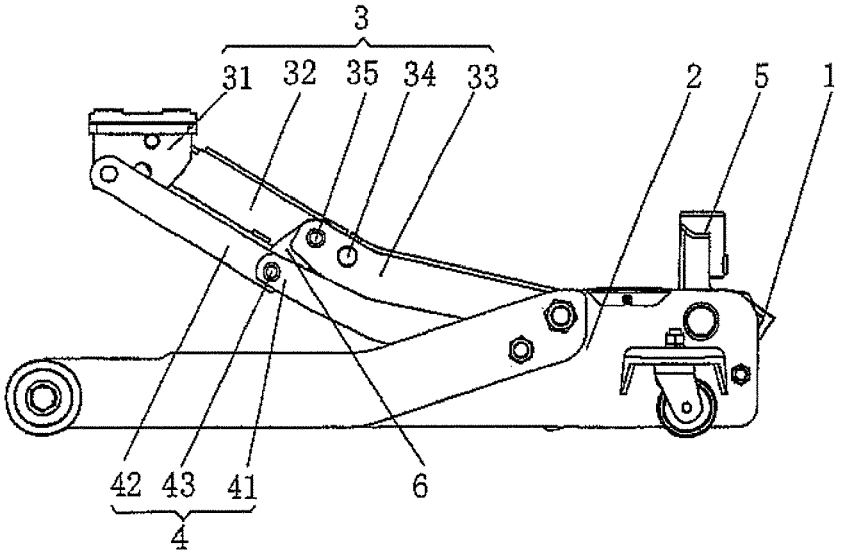
FIG. 2 is a structure illustration of an embodiment of the jack of the present invention in lifting state, with the jibs and the link rods in a normal position.

FIG. 2 shows a structure illustration according to an embodiment of the jack of the present invention in lifting state, with the jib and link rods in a normal position.

Referring to FIG. 2, the hydraulic horizontal jack of the embodiment of present invention includes a frame 2, a hydraulic unit 1, a jib unit 3, link rods 4, a handle 5, and a connecting plate 6. The frame 2, hydraulic unit 1, and handle 5 are well-known in prior art, and therefore will not be described further here. The technical feature of an embodiment of the present invention is the improvement of the jib unit 3 and link rods 4; wherein, the jib unit 3 includes a bracket 31, a front arm 32, a rear arm 33, a set pin 34, and a pin roll 35. The bracket 31 is hinged to one end of the front arm 32, the other end of the front arm 32 is hinged via the pin roll 35 to one end of the rear arm 33, and the other end of the rear arm 33 is pivotally attached to the frame 2; the set pin 34 is arranged between the front arm 32 and the rear arm 33 to form a fixed joint between them; the link rods 4 include a first link rod 41, a second link rod 42, and a link rod pin 43, wherein, one end of the first link rod 41 is pivotally attached to the frame 31, the other end of the first link rod 41 is hinged via the link rod pin 43 to one end of the second link rod 42, and the other end of the second link rod 42 is hinged to the bracket 31; the connecting plate 6 is arranged between the front arm 32 and the second link rod 42, wherein, one end of the link plate 6 is hinged to the pin roll 35, and the other end of the connecting plate 6 is hinged to the link rod pin 43. When the jack is used to lift a heavy object, with the jib and link rods in a normal position (i.e., the front arm 32 and the rear arm 33 are linked and fixed together by the set pin 34), the handle 5 can be pressed down repeatedly, so that the hydraulic unit 1 drives the jib unit 3 to lift upwards, and finally the bracket 31 jacks up the heavy object. In such a normal position state, the jack can be used to jack up a light automobile with a low chassis, such as a sedan car.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

In view of the foregoing, an embodiment of the present invention provides an adjustable hydraulic horizontal jack. Here, the adjustable hydraulic horizontal jack is a lifting apparatus and includes a frame, a hydraulic unit, a jib unit, link rods, and a handle; wherein, the jib unit includes a bracket, a front arm, a rear arm, a set pin, and a pin roll; the bracket is hinged to one end of the front arm, the other end of the front arm is hinged to one end of the rear arm, and the other end of the rear arm is pivotally attached to the frame; the link rods include a first link rod, a second link rod, and a link rod pin, wherein, one end of the first link rod is pivotally attached to the frame, the other end of the first link rod is hinged via the link rod pin to one end of the second link rod, and the other end of the second link rod is hinged to the bracket; a connecting plate is arranged between the front arm and the second link rod, wherein, one end of the connecting plate is hinged to the pin roll, and the other end of the connecting plate is hinged to the link rod pin; the set pin is used to fix the bracket and the front arm when the jib and link rods are in a folded position, and to fix the front arm and the rear arm when the jib and link rods are in a normal position. The advantages of the jack of the embodiment of the present invention include: the jack has rational structure, can act reliably, can increase the height of the lowest position and load under the condition of equivalent parameters, thus having a wider scope of application.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An adjustable hydraulic horizontal jack, comprising a frame (2), a hydraulic unit (1), a jib unit (3), link rods (4), and a handle (5); wherein, the jib unit (3) comprises a bracket (31), a front arm (32), a rear arm (33), a set pin (34), and a pin roll (35); the bracket (31) is hinged to one end of the front arm (32), the other end of the front arm (32) is hinged via the pin roll (35) to one end of the rear arm (33), and the other end of the rear arm (33) is pivotally attached to the frame (2); the link rods (4) comprise a first link rod (41), a second link rod (42), and a link rod pin (43), wherein, one end of the first link rod (41) is pivotally attached to the frame (2), the other end of the first link rod (41) is hinged via the link rod pin (43) to one end of the second link rod (42), and the other end of the second link rod (42) is hinged to the bracket (31); a connecting plate (6) is arranged between the front arm (32) and the second link rod (42), wherein, one end of the connecting plate (6) is hinged to the pin roll (35), and the other end of the connecting plate (6) is hinged to the link rod pin (43); the set pin (34) is configured to form a fixed joint between the bracket (31) and the front arm (32) when the jib and link rods are in a folded position, and to form a fixed joint between the front arm (32) and the rear arm (33) when the jib and link rods are in a normal position.

* * * * *